US009995086B2

(12) United States Patent
Zhao et al.

(10) Patent No.: US 9,995,086 B2
(45) Date of Patent: Jun. 12, 2018

(54) CENTER-PILLARED FULL-FACE SHAFT DRILLING MACHINE

(71) Applicant: China Railway Engineering Equipment Group Co., Ltd., Zhengzhou, Henan Province (CN)

(72) Inventors: Hua Zhao, Zhengzhou (CN); Jianbin Li, Zhengzhou (CN); Kleuters Nikolaus, Zhengzhou (CN); Ningchuan Zhang, Zhengzhou (CN); Wei Xiao, Zhengzhou (CN); Xingjian Zhuo, Zhengzhou (CN); Dujuan Wang, Zhengzhou (CN); Lianhui Jia, Zhengzhou (CN); Yanping Dong, Zhengzhou (CN); Qian Zhou, Zhengzhou (CN)

( * ) Notice: Subject to any disclaimer, the term of this patent is extended or adjusted under 35 U.S.C. 154(b) by 0 days. days.

(21) Appl. No.: 15/122,161

(22) PCT Filed: Dec. 9, 2014

(86) PCT No.: PCT/CN2014/093409

§ 371 (c)(1),
(2) Date: Aug. 27, 2016

(87) PCT Pub. No.: WO2015/127808

PCT Pub. Date: Sep. 3, 2015

(65) Prior Publication Data

US 2016/0369629 A1 Dec. 22, 2016

(30) Foreign Application Priority Data

Feb. 27, 2014 (CN) ..... 2014 1 0068510

(51) Int. Cl.
*E21B 7/20* (2006.01)
*E21D 5/04* (2006.01)
(Continued)

(52) U.S. Cl.
CPC ..... *E21B 7/203* (2013.01); *E21B 15/003* (2013.01); *E21D 1/00* (2013.01); *E21D 1/06* (2013.01);
(Continued)

(58) Field of Classification Search
CPC ..... E21B 15/003; E21B 7/203; E21D 5/04; E21D 1/06; E21D 1/00
See application file for complete search history.

(56) References Cited

U.S. PATENT DOCUMENTS 4,629,014 A * 12/1986 Swisher ..... E21B 15/02 173/141
2012/0318581 A1* 12/2012 Webb ..... E21F 13/04 175/57

* cited by examiner

*Primary Examiner* — Giovanna C. Wright
*Assistant Examiner* — Kristyn A Hall
(74) *Attorney, Agent, or Firm* — Novoclaims Patent Services LLC; Mei Lin Wong

(57) ABSTRACT

A center-pillared full-face shaft drilling machine comprises a center pillar (1), device platforms (2), a derrick (3), a driving system (4), a personnel and material conveying system (5), a well wall support and protection system (6), a safeguard system (7), and an operation chamber (8). The derrick (3) is mounted at a wellhead. The operation chamber (8) is disposed on the derrick (3). The center pillar directly leads from the well bottom to the wellhead and is connected to a slide rack comprised in the derrick on the ground. The driving system (4) is mounted at the front end of the center pillar (1) of a device. The multiple device platforms (2) are sequentially mounted on the center pillar (1) of the device from rear to front. The personnel and material conveying system (5) and the safeguard system (7) are separately mounted on the device platforms at the rear of the driving system (4) and on the ground. The well wall support and protection system (6) is mounted on the device platforms at the rear of the driving system (4) and around the driving
(Continued)

system (4). The shaft drilling machine solves the construction problem of large shafts in mines and the like, implements parallel construction operations of automated mechanical integrated complete devices having a series of functions such as shaft driving, residue discharging, support and protection, drainage and ventilation, facilitates dismounting and mounting of the device, saves preparation time, improves the construction efficiency, reduces construction cost, improves construction safety, and has a wide application range.

9 Claims, 9 Drawing Sheets

(51) Int. Cl.

| | |
|---|---|
| ***E21D 5/12*** | (2006.01) |
| ***E21D 1/00*** | (2006.01) |
| ***E21D 1/06*** | (2006.01) |
| ***E21B 15/00*** | (2006.01) |
| *E21B 4/00* | (2006.01) |
| *E21B 7/00* | (2006.01) |
| *E21B 21/01* | (2006.01) |
| *E21B 33/13* | (2006.01) |

(52) U.S. Cl.
CPC ..... *E21D 5/04* (2013.01); *E21D 5/12* (2013.01); *E21B 4/00* (2013.01); *E21B 7/00* (2013.01); *E21B 15/00* (2013.01); *E21B 21/01* (2013.01); *E21B 33/13* (2013.01)

CENTER-PILLARED FULL-FACE SHAFT DRILLING MACHINE

BACKGROUND OF THE PRESENT INVENTION

Field of Invention

The present invention relates mining machinery, and more particularly to a center pillar and full face vertical shaft drilling machine.

Description of Related Arts

Existing shaft sinking methods has experienced long-term development. The method of shaft sinking mainly includes drilling and blasting, shaft boring and etc. The construction technology has matured. The shaft sinking equipment also experienced the same development and the equipment technology has matured also. Follow the traditional construction method makes it very difficult to realize automation, and it is very difficult for parallel operation while the labor requirement is great. After numerous improvements, the shaft sinking equipment technology of our nation has matured. It is very difficult to further improve the construction efficiency through the advancement of one single equipment, thus a brand new equipment is urgently needed to increase the construction efficiency.

SUMMARY OF THE PRESENT INVENTION

An objective of the present invention is to overcome the problems of existing devices and provide a center pillar and full face vertical shaft drilling machine which has high level of automation and mechanization for vertical shaft construction, thereby the construction time is fast and safe, the vertical shaft construction for a large diameter and a great depth can be achieved and the construction cost is relatively low.

In order to solve the above problem, the technological solution is provided as follows:

In one aspect of the present invention, it provides a center pillar and full face vertical shaft drilling machine which comprises a center pillar, a device platform, a derrick, a boring system, a transportation system for people and materials, a support system for wall reinforcement system, a safety system and a control room, characterized in that, a derrick is provided at a shaft head on which the control room is located, the center pillar extended from a shaft bottom to the shaft head directly while connecting to a sliding frame of the derrick, the boring system is installed at a front end of the center pillar, and on the center pillar sequentially from a rear end to the front end installed a plurality of device platforms, a transportation system for people and materials, and the safety system is installed on the device platform located a rear end of the boring system and the ground surface, the support system for wall reinforcement system is installed on the device platform located at the rear end of the boring system and its surrounding.

The center pillar comprises a plurality segments of main body, each having a hollow columnar structure, connected through flanges and fastening members to form the center pillar, wherein a primary hoist rail, a secondary hoist rail, a cable, a compressed air pipe, a concrete pipe, a clean water pipe, a pipe for slurry outflow, a pipe for slurry inflow and a mounting base for stabilizer are arranged along the peripheral edges of the main body of the center pillar, the hollow portion of the center pillar defines a passage for a ventilation and water passage module of the safety system, the safety system comprises a fan installed directly at an inner side of the center pillar.

The device platform comprises a fixed platform; and a retractable platform which is installed in a segment of module lining of the center pillar, wherein the retractable platform comprises a base platform, a small platform, a retractable cylinder and a seal member, wherein the base platform is fixedly connected to the center pillar and the retractable cylinder is fixedly provided around a peripheral edge portion of the base platform horizontally, wherein the retractable cylinder comprises a piston shaft and is connected to the small platform through one end of the piston shaft, wherein the small platform has an outer portion at which the seal member is provided, wherein the seal member has an outer end which is in contact with the module lining of the center pillar.

The derrick comprises a main body of derrick, a sliding frame, an pillar for sliding frame, a lifting cylinder, a movement arrangement, a crane for pillar, a manipulator for pillar, a power station and a muck chute; wherein the main body of derrick has a lower portion at which the movement arrangement is provided and an upper portion at which the pillar for sliding frame and the power station are installed, wherein the pillar for sliding frame guides a sliding movement of the sliding frame, wherein the lifting cylinder has one end connected to the sliding frame and another end connected to a bottom end of the pillar for sliding frame, wherein the crane for pillar is installed on the upper portion of the main body of derrick, wherein the manipulator for pillar and the muck chute are inclined and installed at the lower portion of the main body of derrick.

The boring system for the vertical shaft drilling comprises a cutter head with rear mounting construction, a retractable shield, a shield positioning ring, a main driver, a shield cylinder, a guiding pillar, a propulsion cylinder, a gripper sliding ring, a gripper and a gripper cylinder; wherein the cutter head is connected to the main driver, the main driver has an upper portion connecting to the guiding pillar, the guiding pillar has a upper portion connecting to the center pillar, the main driver is connected to the shield positioning ring, the shield positioning ring is connected to the retractable shield through telescopic structure and the shield cylinder to form a ring-shaped retractable shield, the guiding pillar has a key structure and has a sliding connection with the gripper sliding ring while both the guiding pillar and the gripper sliding ring are connected through the plurality of propulsion cylinders provided around all sides, the gripper is connected to the gripper sliding ring through telescopic structure and the gripper cylinder, the control station is installed on an upper portion the gripper.

The transportation system for people and materials comprises a slurry pump, a slurry inflow pipe, a slurry outflow pipe, a primary vibrating screen, a secondary vibrating screen, a tertiary vibrating screen, a primary hydrocyclone device, a secondary hydrocyclone device, a muck storage, a slurry storage tank, a rapid feeding device, a bucket, a main hoist, an auxiliary hoist, a slurry return pipe, a transportation pump, a slurry output pipe, a slurry input pipe, a primary slurry pump, a secondary slurry pump, a primary slurry tank, a secondary slurry tank and a cage; wherein the slurry pump is installed inside the main driver, the slurry inflow pipe is extended to inside the cutter head, the slurry outflow pipe has an inlet connected to the slurry pump and an outlet connected to the primary vibrating screen, the primary vibrating screen has a slag outlet corresponding to the muck storage, an slag outlet of the muck storage is connected to the primary slurry tank, the primary slurry tank is thoroughly connected to the secondary slurry tank, the secondary slurry tank has a bottom portion connecting to the primary slurry pump, the primary slurry pump has an inlet connecting to the secondary slurry tank and an outlet connecting to the primary hydrocyclone device, the primary hydrocyclone device has a slag outlet connecting to the secondary vibrating screen and a slurry outlet connecting to the secondary slurry tank and the slurry storage tank respectively, the secondary vibrating screen has a slag outlet corresponding to the muck storage and a slurry outlet connecting to the secondary slurry tank; the slurry storage tank has a bottom portion connecting to the secondary slurry pump, the secondary slurry pump has an inlet connecting to the slurry storage tank and an outlet connecting to the secondary hydrocyclone device, the secondary hydrocyclone device has a slag outlet connecting to the tertiary vibrating screen and a slurry outlet connecting to the slurry storage tank, the tertiary vibrating screen has a slag outlet corresponding to the muck storage and a slurry outlet corresponding to the slurry storage tank; the slurry input pipe is extended to the ground surface through the center pillar and connected to a slurry tank on the ground surface and has a bottom portion connecting to the slurry return pipe, while the slurry return pipe is connected to the slurry storage tank, the slurry return pipe has an outlet terminal arranged on a work surface of the cutter head; the slurry storage tank has a bottom portion connected to the transportation pump, the transportation pump is connected to the slurry output pipe, the slurry output pipe is connected to the pipe for slurry outflow installed on the center pillar and has an outlet arranged on the shaft opening and connected to external slurry treatment station; the muck storage has a bottom portion at which the rapid feeding device is arranged, the bucket and the cage are installed on the center pillar, the main hoist and the auxiliary hoist are installed on the upper portion of the derrick.

The support system for wall reinforcement comprises a module building system and an anchoring system, wherein the module building system comprises an auxiliary crane, a module board, a transportation concrete pipe, a buffer, a concrete mixing tank in shaft bottom, a concrete pump, a grouting pipe, and a concrete sealing ring, the anchoring system comprises a rig vehicle, a rig rail, a lifting cylinder, a multi-functional rig, a shotcreting manipulator and a material hoist; the auxiliary crane of the module building system is installed on a rear side of the device platform for inverted transportation of the module board, the entire module board and the concrete sealing ring forms a casting cavity, the buffer with multi-level is installed on the transportation concrete pipe, the transportation concrete pipe has a bottom end connected to concrete mixing tank, the concrete mixing tank has a bottom portion at which the concrete pump is installed, the concrete pump has an outlet connected to a grouting opening of the entire module board through the grouting pipe; the rig rail of the anchoring system is connected to the sliding ring through the lifting cylinder and has sliding connection with the guiding pillar, the rig vehicle is installed on the rig rail, the multi-functional rig is installed on the rig vehicle, the shotcreting manipulator is also installed on the rig rail, the material hoist is installed at a lower portion of the device platform which is position at a higher position function as an operation platform for steel binding.

The safety system comprises a sinking pump, a power and control module, a ventilation and water passage module, a stabilizer, a stabilizing vehicle for sinking pump, a flat car for shaft cover and a spare pillar, wherein the power control module comprises a main control room, an oil pump, an electrical cabinets, a transformer, an air compressor, a pumping station, a power cable, a communication cables and a cable reel, the ventilation and water passage module comprises a fan, an air duct formed from an inner side of the hollow portion of the center pillar and a clean water pipe, the sinking pump is hanged directly at a bottom portion of the machine through the stabilizing vehicle for sinking pump at the upper portion of the derrick, the sinking pump has a water inlet which penetrates through the retractable shield of the boring system to the slurry storage of the cutter head, the power and control modules are distributed and installed on different device platforms and the ground surface, the stabilizer is installed in the mounting base for stabilizer of the center pillar, the flat car for shaft cover is installed independently on an independent rail on the ground surface, the spare pillar is arranged on a side of the machine for backup.

The entire module board is formed by assembling a plurality groups of individual module board unit and is secured directly onto all sides of the wall of the shaft.

The support system for wall reinforcement further comprises an advanced grouting system and a concrete additives filling apparatus, the advanced grouting system is formed by the multi-functional rig and the grouting pump, the grouting pump is installed on the device platform at a rear position.

The advantageous effect of the present invention are:

1. Structurally, the center pillar and full face vertical shaft drilling machine according to the present invention includes a center pillar, a device platform, a derrick, a boring system, a transportation system for people and materials, a support system for wall reinforcement, a safety system, and a control room, the machine utilizes a new method of shafting sinking and is mainly used for shaft sinking of different kinds of vertical shaft to achieve a full face and high efficient construction for vertical shaft drilling. The present invention is an integrated and complete equipment which integrated all functions of boring, tapping, support, drainage, ventilation, advanced detection together. Thus, parallel operation of shafting sinking, support and slag removal can be realized, high degree of automation and mechanization is achieved, while construction efficiency for vertical shaft drilling is increased and the construction cycle of shafting sinking and boring is shortened. The cost of shaft construction is dramatically lowered and the initial investment of mining site is lowered.

2. Structurally, the center pillar of the present invention is formed by connecting a plurality segments of main body with hollow columnar structure. The center pillar has one end connected to the main driver and another end connecting to the sliding frame of the derrick located on the ground surface. The passage for slag removal, the secondary hoist rail, the cable, the compressed air pipe, the concrete pipe, the clean water pipe, the pipe for slurry outflow, the pipe for slurry inflow and the stabilizer are arranged in the peripheral edges of the center pillar and are passage through from the bottom of the shaft to the ground surface. The use of center pillar can eliminate the use of winch in traditional construction method. The equipment weight is supported by the center pillar. The gravitation force of the cutter head in the bottom of the shaft is controlled through the lifting cylinder located on the ground surface to control the propulsion force of the cutter head such that the propulsion equipment is simplified and the overall structure is simplified. The equipment and the different types of pipelines from the ground surface are attached to the center pillar such that the pipeline extension from the ground surface is achieved, thereby the pipelines extension is much more convenience, the pipelines in the bottom is avoided, and the slag removal of the main hoist is greatly increased. The lifting device employs rigid track element and is attached to the center pillar, which replaces the traditional guide rope design, that the rigid track element is much safer and the speed of lifting is much faster, thus the transportation speed of materials is much faster. The center pillar has a hollow construction and functions as an air dryer, that this internal fan design can quickly discharge the polluted gas from the bottom of the shaft to outside and ensure the air quality in the bottom of the shaft.

3. Structurally, the retractable platform of the present invention includes a base platform, a small platform, a retractable cylinder and a seal member. The structure is simple, which can fulfill the requirement of passage of the module board, seal the gap in the shaft quickly, and prevent personal injury accidents caused by falling objects. The design is simple but reliable.

4. Structurally, the boring system includes components such as a cutter head, a main driver, a retractable shield and a shield cylinder for full face vertical shaft drilling. The boring system also includes a cylinder for directional adjustment in which one end of the shaft of the cylinder is connected to the shield positioning ring through sliding engagement and the barrel is fixed connected to the main driver, thereby the position of the main driver is adjusted through the controlling the cylinder for directional adjustment, hence the adjustment of drilling direction is realized. The center pillar has one end installed onto the main driver and another end connected to the derrick on the ground surface, thus through the sliding frame of the derrick to control the applied pressure to the equipment, speedy excavation under different stratum conditions can be achieved and the operation is convenience.

5. Structurally, the transportation system for people and materials according to the present invention includes a main hoist and an auxiliary hoist, a bucket, a cage, slurry pipes, slag pumps, arrangements for multi-level slurry treatment, and etc. to realize transportation of objects and materials such as personnel, slag and steel materials between the ground surface and the shaft. Personnel and material transportation between the shaft surface and the shaft bottom are realized by the auxiliary hoist. The slag transportation are divided into two parts. First, the slurry pump transports the slag carried by the slurry through the slurry outflow pipe to the slurry treatment devices, screening the large size sediments to the muck storage, then through the rapid feeding device positioned at the bottom portion of the muck storage to load the sediments into the bucket, and through the sliding groove member 309 of the derrick to load into the slag vehicle to transport to a predetermined location. The slurry is processed through multi-level screening and separation. Through treatment by the hydrocyclone devices, the slurry is transported to the slurry storage tank, then backflows to operation site through the slurry return pipe for recycling use. The highly concentrated slurry deposited on the bottom of the slurry storage tank is guided to flow to the transportation pump, the transportation pump is arranged to pump the highly concentrated slurry to flow through the slurry output pipe to the ground surface. The quality slurry from the ground surface is transported to the shaft bottom through the slurry input pipe. The above system works together to complete the transportation from the ground surface to the shaft bottom for personnel, materials, slag and slurry. The entire transportation system has an overall reasonable structural design. The transport of personnel, materials, slag and slurry can be operate at the same time. The equipment utility rate is increased and the work efficiency is increased.

6. Structurally, the support system for wall reinforcement according to the present invention includes a module board, a transportation concrete pipe, a buffer, a piston pump, a grouting pump, a multi-functional rig, a shotcreting manipulator and etc. for the immediate support of the shaft wall. Furthermore, the rig vehicle can be used. The rig hydraulically controls the multi-functional rig for operation of anchoring, advanced detection and advanced grouting. Accordingly, the support system for wall reinforcement is capable of providing a number of operation platform for different tasks such as anchoring, casting and advanced grouting, that the support system provides reliable support while is capable of meeting the need of construction under different stratum conditions.

7. Structurally, the safety system of the present invention comprises power arrangement, control arrangement, ventilation arrangement, water passage arrangement and etc. such that the need to safeguard the operation of equipment and the live of worker in the shaft is provide, and the normal operation of equipment and workers are ensured. The main hoist rail, the secondary hoist rail, the cable, the compressed air pipe, the concrete pipe, the clean water pipe, the pipe for slurry outflow, the pipe for slurry inflow and the stabilizer are all arranged on the center pillar and are extended downwardly together with the equipment. After the particular stroke of one center pillar and its pipelines is completed, the flat car is utilized to lock the flange of the center pillar, remove the connecting bolts, move the sliding frame at an upward position and disconnect the center pillar, then the spare pillar is lifted rapidly through the crane for pillar and the connection of the pillars are completed precisely through the control of the manipulator for pillar for the extension process of the center pillar without the need of pipe transportation to the bottom of the shaft. The process is fully mechanized, simple and convenience, fast and has low level of labor requirement, thus the equipment efficiency is increased.

8. Structurally, according to the present invention, the entire module board employs groups of individual module board units which are constructed and casted together, thus continuous casting can be achieved. The concreting time of the wall is long, the module board can be dissembled and transported conveniently, and the efficiency and quality of the wall casting is increased.

9. In additional, the center pillar and full face vertical shaft drilling machine according to the present invention is applicable to vertical shaft sinking for different constructions, which includes tunnel excavation, hydropower, nuclear power and underground engineering construction, that the underground construction channel can be open and fast and safe underground construction can be realized. The applicability is wide and is suitable for implementation promotion.

10. Accordingly, the center pillar and full face vertical shaft drilling machine according to the present invention solves the construction problem of large-scale shaft sinking for coalmines, realizes the parallel operation for construction with automated, mechanized and integrated sets of equipment which includes serial functions of boring and propulsion, slag removal, support and protection, water passage and ventilation. The installation and disassembly process is convenience, the preparation time is saved, the construction efficiency is increased, the construction cost is lowered, and the construction safety is increased while the applicable area is wide. Therefore, very suitable for implementation promotion.

BRIEF DESCRIPTION OF THE DRAWINGS

The following is a brief description of the preferred embodiments of the present invention with accompanying drawings, wherein.

The numerical references in the drawings.

1. Center pillar; 101. Main pillar; 102. Primary hoist rail; 103 secondary hoist rail; 104. Cable; 105. Compressed air pipe; 106. Concrete pipe; 107 clean water pipe; 108. Pipe for slurry outflow; 109. Pipe for slurry inflow; 110. Mounting base for stabilizer; 2. Device platform; 201. Fixed platform; 202. Retractable platform; 202-1. Base platform; 202-2. Small platform; 202-3. Retractable cylinder; 202-4. Seal member; 3. Derrick; 301. Main body of derrick; 302. Sliding frame; 303. Pillar for sliding frame; 304. Lifting cylinder; 305. Movement arrangement; 306. Crane for pillar; 307. Manipulator for pillar; 308. Power station; 309. Muck chute; 4. Boring system; 401. Cutter head; 402. Retractable shield; 403. Shield positioning ring; 404. Main driver; 405. Operation station; 406. Shield cylinder; 407. Guiding pillar; 408. Propulsion cylinder; 409. Gripper sliding ring; 410. Gripper; 411. Gripper cylinder; 5. Transportation system for people and materials; 501. Slurry pump; 502. Slurry inflow pipe; 503. Slurry outflow pipe; 504. Primary vibrating screen; 505. Secondary vibrating screen; 506. Tertiary vibrating screen; 507. Primary hydrocyclone device; 508. Secondary hydrocyclone device; 509. Muck storage; 510. Slurry storage tank; 511. Rapid feeding device; 512. Bucket; 513. Main hoist; 514. Auxiliary hoist; 515. Slurry return pipe; 516. Transportation pump; 517. Slurry output pipe; 518. Slurry input pipe; 519. Primary slurry pump; 520. Secondary slurry pump; 521. Primary slurry tank; 525. Secondary slurry tank; 523. Cage; 6. Support system for wall reinforcement; 601. Auxiliary crane; 602. Module board; 603. Transportation concrete pipe; 604. Buffer; 605. Concrete mixing tank in the shaft bottom; 606. Concrete pump; 607. Grouting pipe; 608. Concrete sealing ring; 609. Rig vehicle; 610. Rig rail; 611. Lifting cylinder; 612. multi-functional rig; 613. Shotcreting manipulator; 614. Material hoist; 615. Grouting pump; 7. Safety system; 701. Sinking pump; 702. Power control module; 703. Ventilation and water passage module; 704. Stabilizer; 705. Stabilizing vehicle for sinking pump; 706. Flat car for shaft cover; 707. Spare pillar; 8. Control room.

DETAILED DESCRIPTION OF THE PREFERRED EMBODIMENT

Embodiment 1

Figure 1:
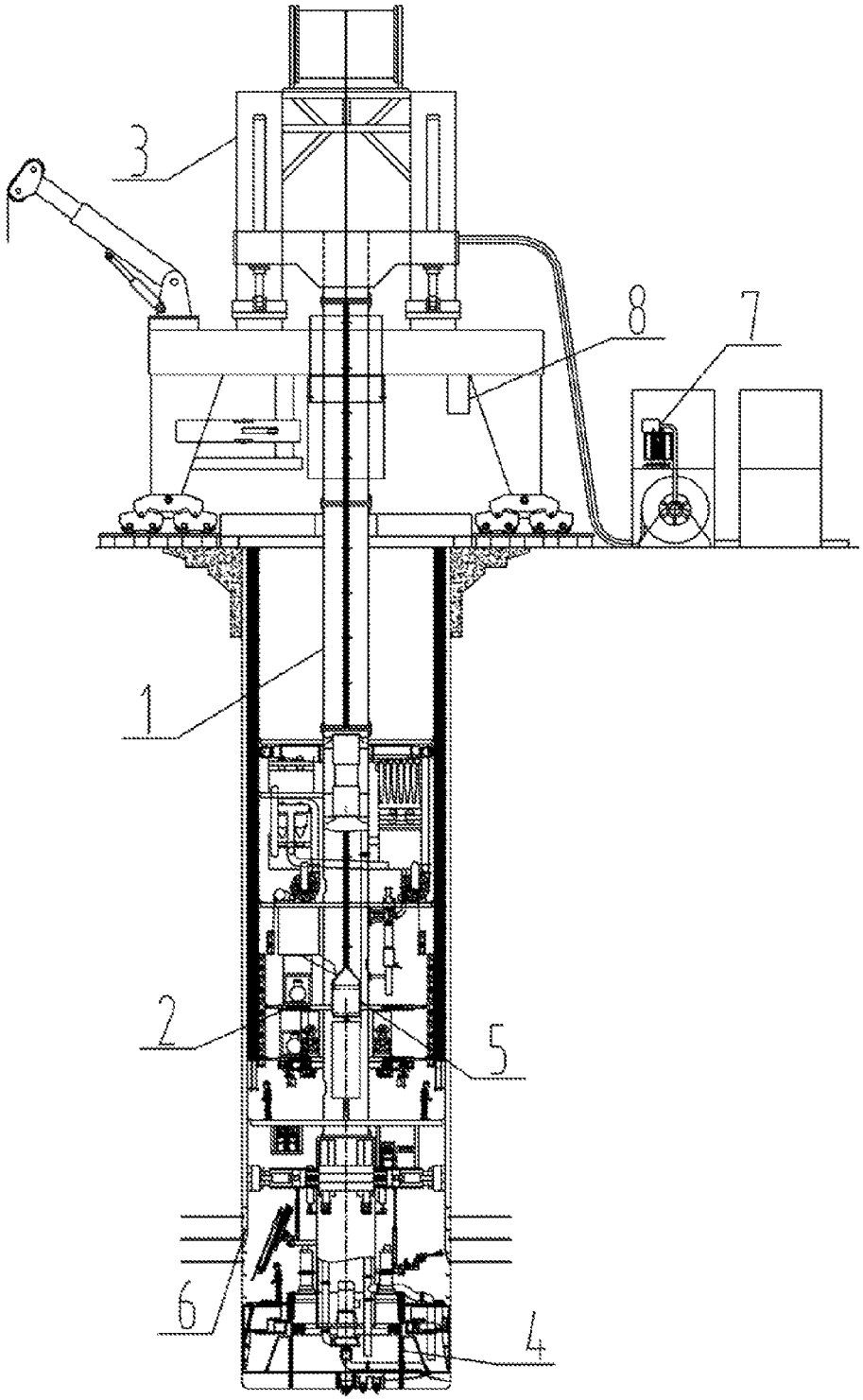
FIG. 1 is a schematic diagram of a center pillar and full face vertical shaft drilling machine according to a preferred embodiment of the present invention.

Referring to FIG. 1 of the drawings, a center pillar and full face vertical shaft drilling machine according to the preferred embodiment of the present invention is illustrated. The machine comprises a center pillar 1, a device platform 2, a derrick 3, a boring system 4, a transportation system for people and materials 5, a support system for wall reinforcement 6, a safety system 7, and a control room 8. Each system is constructed by independent equipment. The derrick is installed at a wellhead and the derrick comprises the control room. The center pillar is extended from a well bottom through the wellhead directly while connecting to a sliding frame of the derrick. The boring system is installed at a front end of the center pillar. A plurality of device platforms are installed on the center pillar sequentially from its rear end to its front end. The transportation system for people and materials and the safety system are installed on the device platforms located a rear end of the boring system respectively. The support system for wall reinforcement system is installed on the device platform located at the rear end of the boring system and the surrounding of the device platform.

Figure 2:
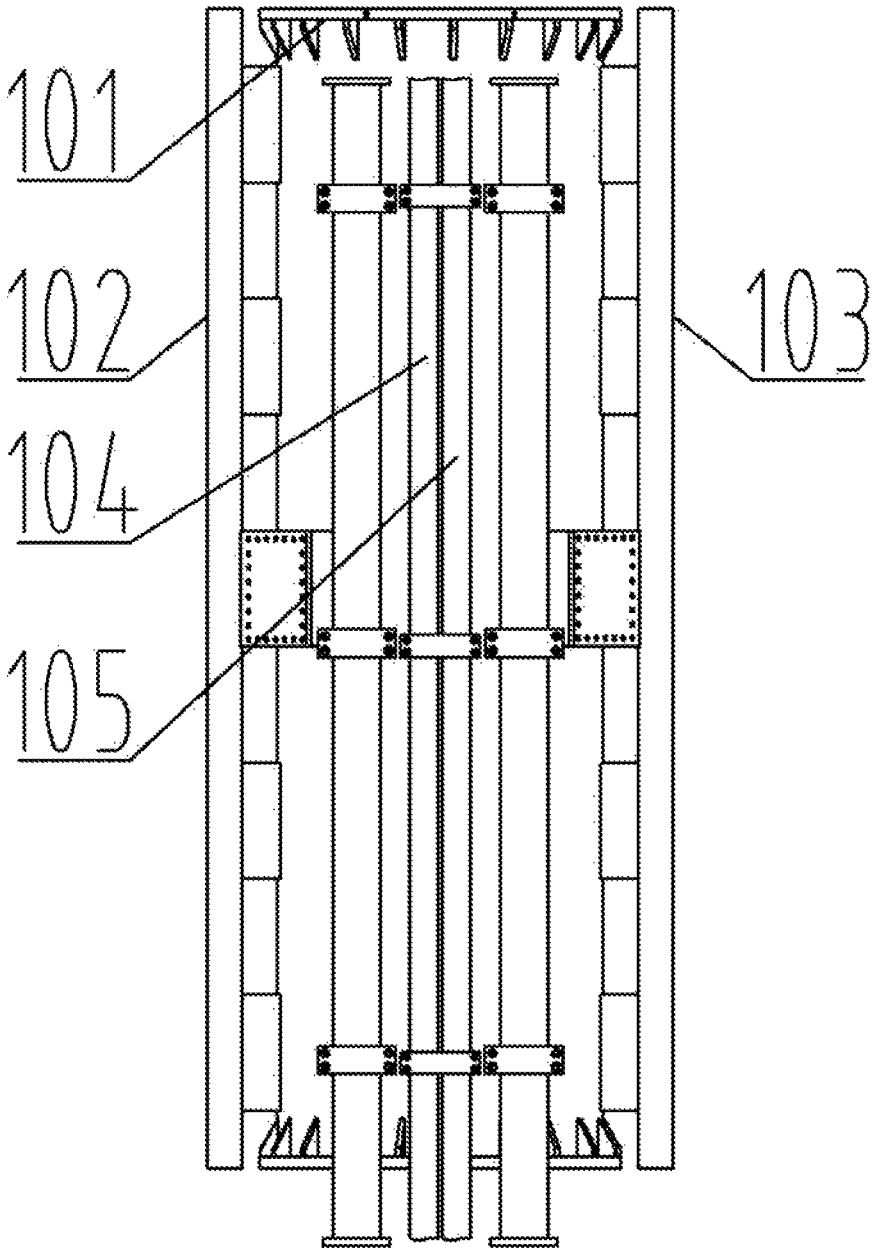
FIG. 2 a schematic diagram of a main body and its peripherals of a center pillar and full face vertical shaft drilling machine according to a preferred embodiment of the present invention.
Figure 3:
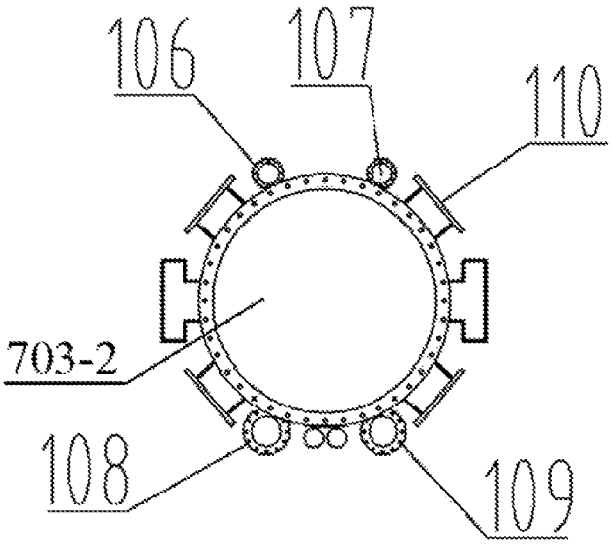
FIG. 3 is a top view illustration of the schematic diagram of the main pillar and its peripherals of a center pillar and full face vertical shaft drilling machine according to a preferred embodiment of the present invention of FIG. 2.

Referring to FIGS. 2-3 of the drawings, the center pillar comprises a plurality segment of main body 101 having a hollow columnar structure which are connected through flanges and fastening members together to form the center pillar. A primary hoist rail 102, a secondary hoist rail 103, a cable 104, a compressed air pipe 105, a concrete pipe 106, a clean water pipe 107, a pipe for slurry outflow 108, a pipe for slurry inflow 109 and a mounting base for stabilizer 110 are arranged along the peripheral edges of the main body of the center pillar.

Figure 4:
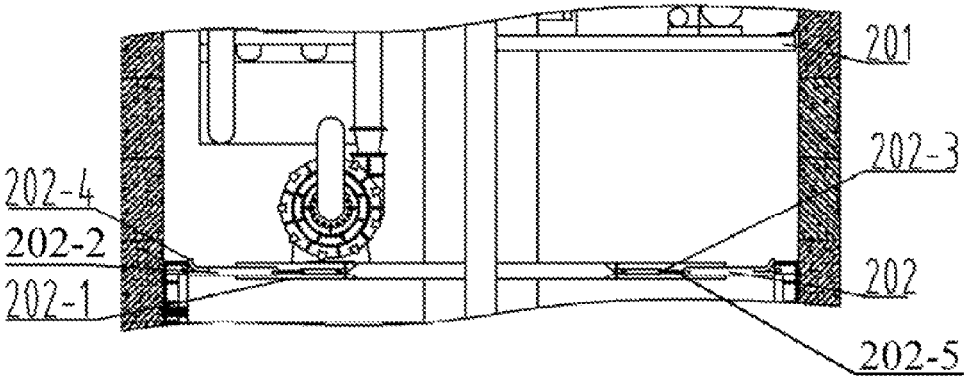
FIG. 4 is a schematic diagram of a device platform of the center pillar and full face vertical shaft drilling machine according to the preferred embodiment of the present invention.

Referring to FIG. 4 of the drawings, the device platform comprises a fixed platform 201 and a retractable platform 202, wherein the retractable platform comprises a base platform 202-1, a small platform 202-2, a retractable cylinder 202-3 and a seal member 202-4. The retractable platform 202 is installed on a module lining segment. The base platform 202-1 is fixedly connected to the center pillar 1. The retractable cylinder 202-3 drives the small platform 202-2 to extend or retract. The seal member 202-4 prevents pieces of small material from falling through any gap of the platform.

Figure 5:
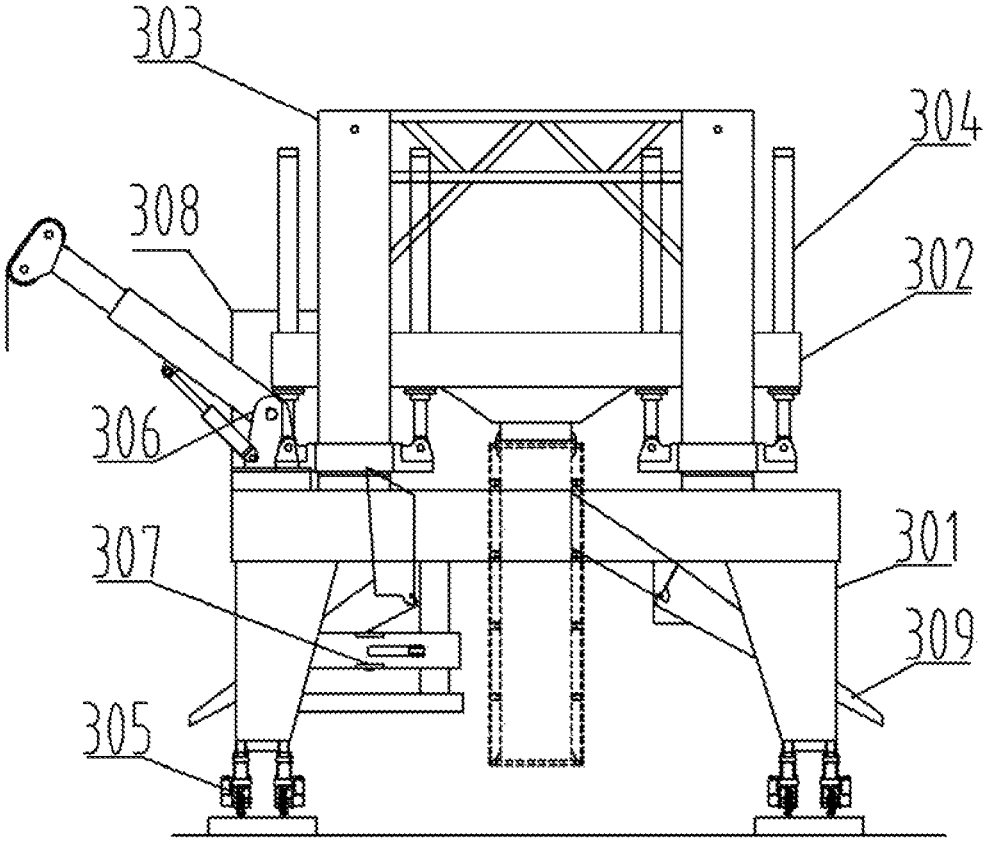
FIG. 5 is a schematic diagram of a derrick of the center pillar and full face vertical shaft drilling machine according to the preferred embodiment of the present invention.

Referring to FIG. 5 of the drawings, the derrick comprises a main body of derrick 301, a sliding frame 302, an pillar for sliding frame 303, a lifting cylinder 304, a movement arrangement 305, a crane for pillar 306, a manipulator for pillar 307, a power station 308, and a muck chute 309. The main body of the derrick 301 has a lower portion through which the movement arrangement 305 is installed; and an upper portion on which the pillar for sliding frame 303 and the power station 308 are installed. The pillar for sliding frame 303 serves as a sliding rail for the sliding frame 302. The lifting cylinder 304 has one end connected to the sliding frame 304 and another end connected to a bottom end of the pillar for sliding frame 303. The crane for pillar 306 is installed at an upper portion of the main body of derrick 301. The manipulator for pillar 307 and the muck chute 309 are installed in the lower portion of the derrick.

Figure 6:
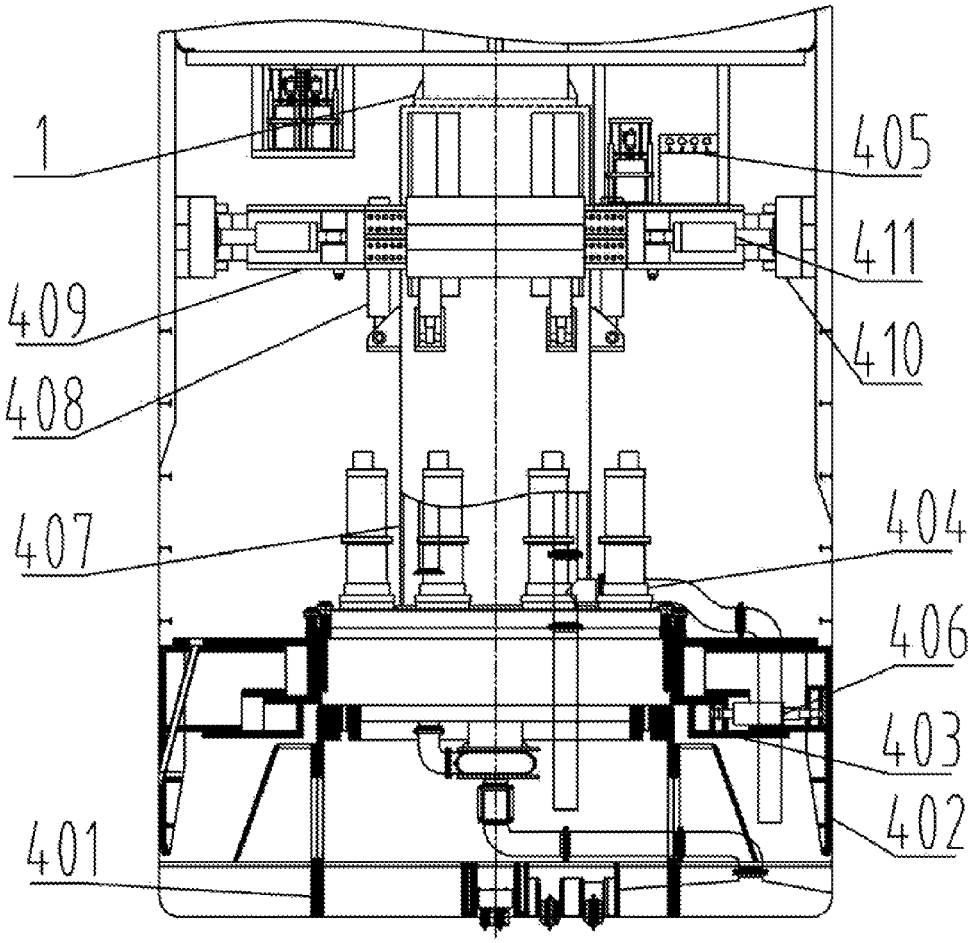
FIG. 6 is a schematic diagram of a boring system of the center pillar and full face vertical shaft drilling machine according to the preferred embodiment of the present invention.

Referring to FIG. 6 of the drawings, the boring system for the vertical shaft drilling comprises a cutter head 401, a retractable shield 402, a shield positioning ring 403, a main driver 404, an operation station 405, a shield cylinder 406, a guiding pillar 407, a propulsion cylinder 408, a gripper sliding ring 409, a gripper 410 and a gripper cylinder 411. The cutter head 401 is driven by the main driver 404 to process excavation and rock breaking. A plurality of retractable shields 402 are arranged for forming a ring structure to act on the rock firmly through the shield cylinder 406 to produce friction such that anti-torque is provided to the machine. The guiding pillar 407 and the gripper sliding ring 409 are connected through sliding key connection. The gripper 410 is firmly gripped onto the wall surface through the gripper cylinder 411 to product friction such that the gripper 410 and the gripper sliding ring are secured into position, thereby any rotational movement of the guiding pillar 407 is prevented, the propulsion direction of the machine is stabilized, accessory anti-torque to the retractable shield 402 is provided, and the propulsion cylinder 408 completes reciprocating movement during the excavating process of the gripper. The center pillar 1 is extended along the entire vertical shaft and connects to the main devices and the forward driving force and excavation speed of the machine is controlled through the lifting cylinder 304 of the derrick 3. The retraction movement of the shield cylinder 406 and the gripper cylinder 411 is controlled and used to control the main driver 404 to having shifting movement such that the direction adjustment of the cutter head 401 is achieved. The operation station 405 is located at a lower position of the platform above the gripper, therefore the operation and control of the center pillar and full face vertical shaft drilling machine is convenience and comfortable. The system design is simple. The control is reliable. The center pillar and full face vertical shaft drilling machine is capable of providing sufficient driving force and torque for excavation at high speed while providing effective control on excavation direction such that the quality of shaft formation efficiency and construction is ensured.

Figure 7:
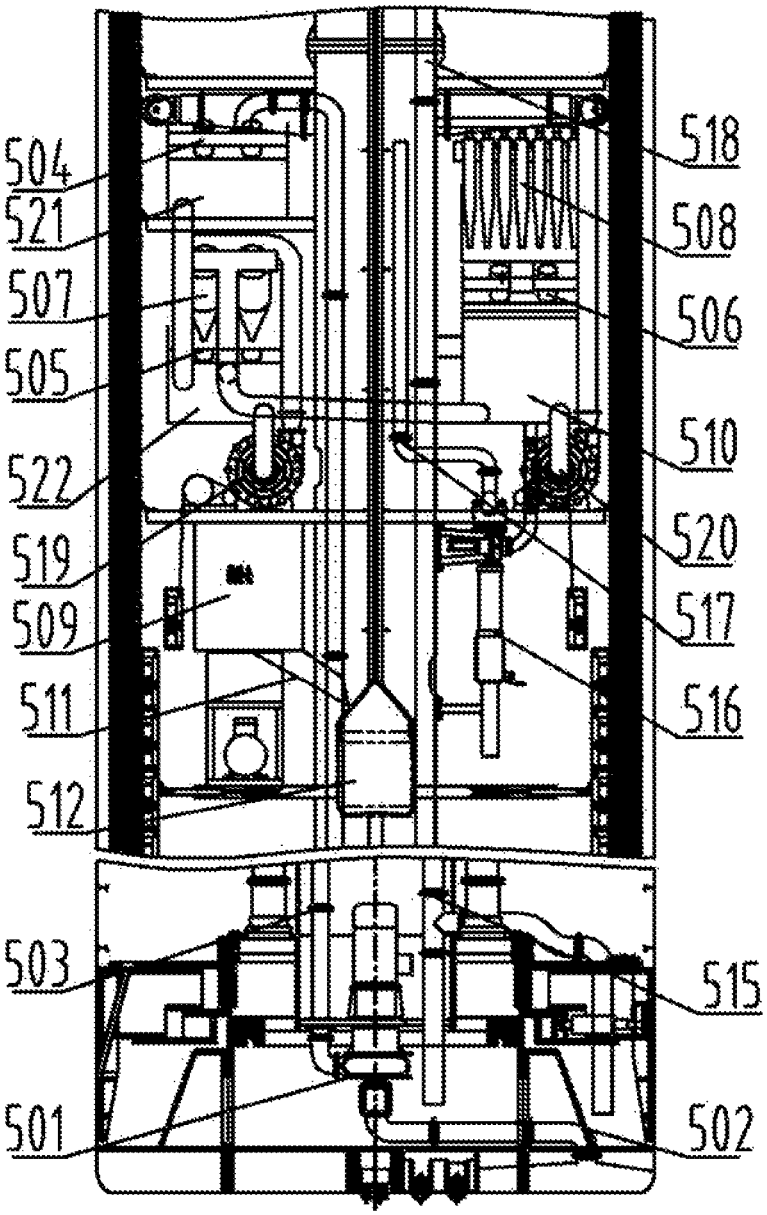
FIG. 7 is a schematic diagram of a transportation system for people and materials of the center pillar and full face vertical shaft drilling machine according to the preferred embodiment of the present invention.
Figure 8:
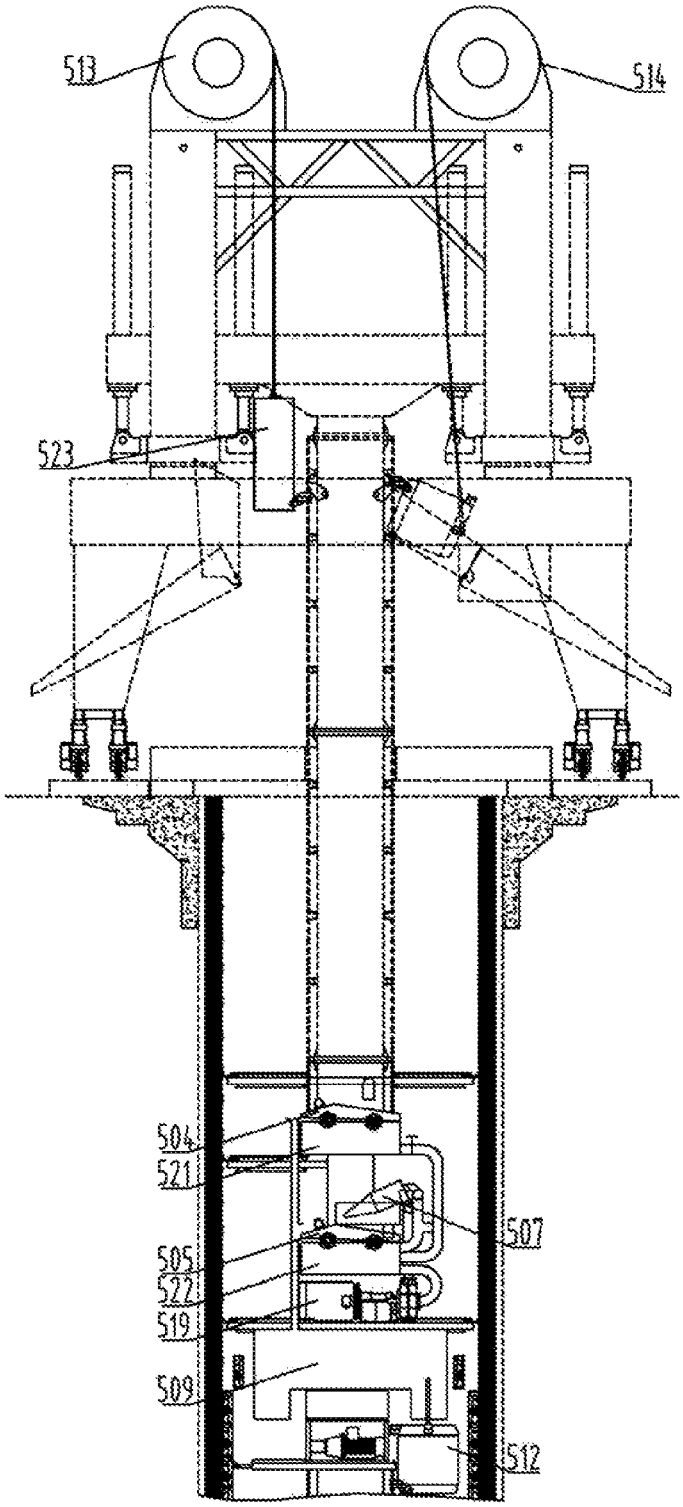
FIG. 8 is a side view illustration of a schematic diagram of a transportation system for people and materials of the center pillar and full face vertical shaft drilling machine according to the preferred embodiment of the present invention.

Referring to FIGS. 7-8 of the drawings, the transportation system for people and materials 5 comprises a slurry pump 501, a slurry inflow pipe 502, a slurry outflow pipe 503, a primary vibrating screen 504, a secondary vibrating screen 505, a tertiary vibrating screen 506, a primary hydrocyclone device 507, a secondary hydrocyclone device 508, a muck storage 509, a slurry storage tank 510, a rapid feeding device 511, a bucket 512, a main hoist 513, an auxiliary hoist 514, a slurry return pipe 515, a transportation pump 516, a slurry output pipe 517, a slurry input pipe 518, a primary slurry pump 519, a secondary slurry pump 520, a primary slurry tank 521, a secondary slurry tank 522 and a cage 523. Personnel and materials such as steel are transported by auxiliary hoist 514 and the cage 523 for personnel and material transportation between the shaft surface and the shaft bottom. The slag transportation is divided into two parts, which are the dried residue and the fluidic slurry. The slag broken down by the cutter head 401 is carried by the slurry and is suck into the slurry inflow pipe 502 which is deeply inserted into the cutter head through the slurry pump 501, the slurry is transported to the primary vibrating screen 504 through the slurry outflow pipe 503 to process separation by the primary vibrating screen 504, some of the large size sediment enters into the muck storage 509 and the slurry after separation enters the primary slurry tank 521, the primary slurry tank 521 and the secondary slurry tank 522 are inter-connected by interconnecting pipe, the slurry then enters into the secondary slurry tank 522 through the interconnecting pipe, the primary slurry pump 519 at the bottom of the secondary slurry tank 522 providing pumping action to transport the slurry to the primary hydrocyclone device 507 for separation process through action of the primary hydrocyclone device 507, the slurry after separation process has further separation process through the secondary vibrating screen 505, the dried sediment enters into the muck storage 509 and the slurry enters into the secondary slurry tank 522 for recycling treatment, the slurry after separation process of the primary hydrocyclone device 507 is transported to the slurry storage tank 510 or the secondary slurry tank 522, the secondary slurry pump 520 at the bottom of the slurry storage tank 510 provides pumping action to transport the slurry to the secondary hydrocyclone device for separation process through action of the secondary hydrocyclone device 508, then the slurry after separation process has further separation process through the tertiary vibrating screen 506, the dried sediment enters into the muck storage 509 and the slurry enters into the slurry storage tank 510, separation process of the slurry is then processed by the secondary hydrocyclone device 508 and the slurry is transported to the slurry storage tank 510 for storage and future use. The sediment stored inside the muck storage 509 is loaded into the bucket 512 rapidly through the rapid feeding device 511 positioned at a bottom portion and is transported outside the shaft through the main hoist 513, then is loaded to a vehicle through the muck chute 309 to transport to a predetermined location. The slurry stored inside the slurry storage tank 510 is backflow to the slurry storage of the cutter head through the slurry return pipe 515 for another cycle. The highly concentrated slurry deposited on the bottom of the slurry storage tank 510 is flowing to the transportation pump 516, passing to the slurry output pipe 517 and the pipe for slurry outflow 108 of the center pillar through the transportation pump 516 to reach a treatment station on the ground surface for arrangement of further processing. The high quality slurry required by the shaft body is transported to the slurry storage tank 510 directly through the slurry input pipe 518 and the pipe for slurry inflow 109 of the center pillar to meet the need of the construction inside the shaft body. The system utilizes the slurry to carry sediments and processes wet and dry separation of slurry and sediments. The people and objects has separate transportation arrangement. The realization of low power consumption and high efficiency slag removal is achieved. Each of the above systems can work together to provide transportation of people, materials, sediments and slurry between the well surface and the well bottom, therefore high efficiency transportation of materials and slag removal for the construction is ensured.

Figure 9:
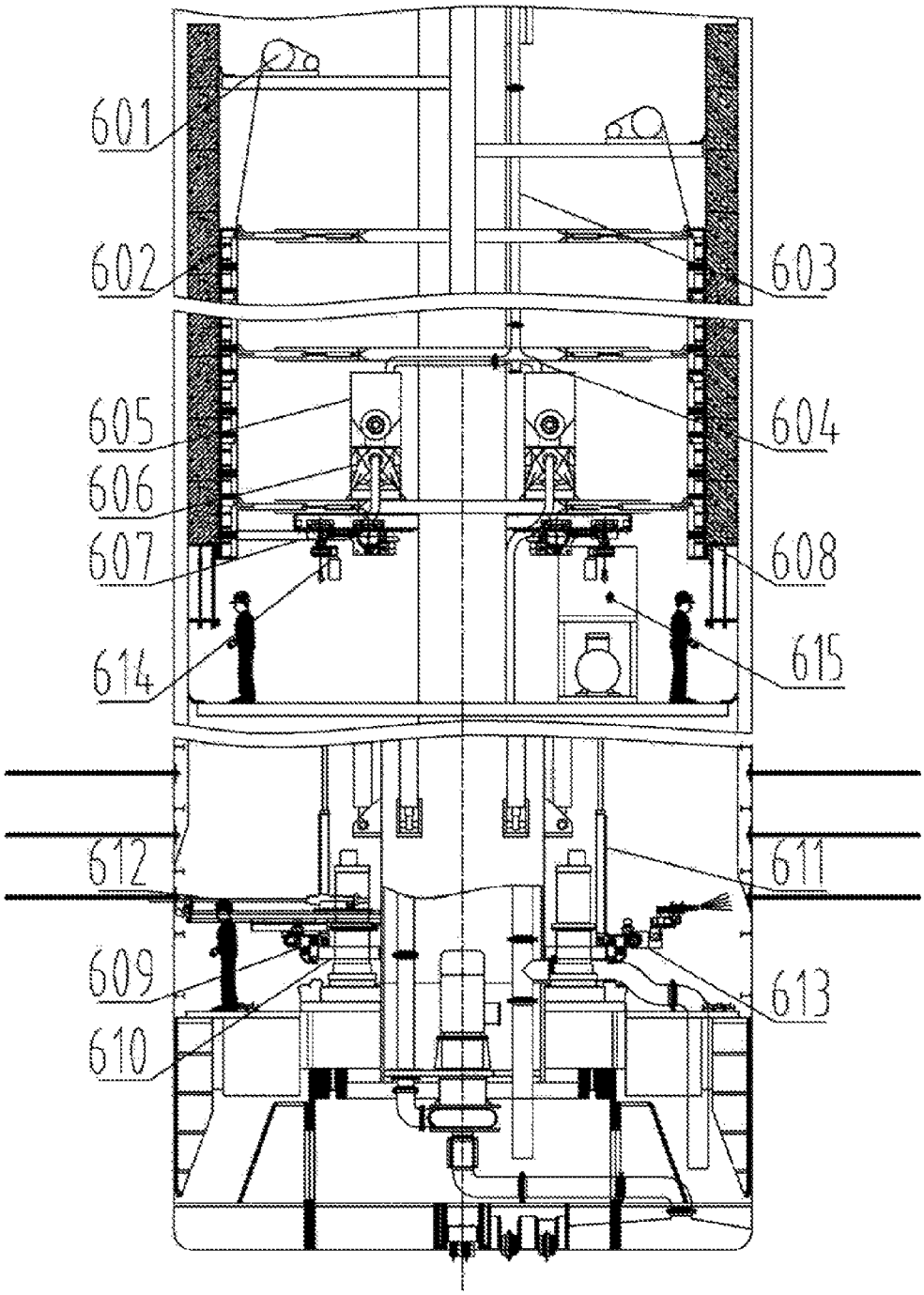
FIG. 9 is a schematic diagram of a support system for wall reinforcement system of the center pillar and full face vertical shaft drilling machine according to the preferred embodiment of the present invention.

Referring to FIG. 9 of the drawings, the support system for wall reinforcement 6 comprises a module building system and an anchoring system. The module building system comprises an auxiliary crane 601, a module board 602, a transportation concrete pipe 603, a buffer 604, a concrete mixing tank 605 in shaft bottom, a concrete pump 606, a grouting pipe 607, and a concrete sealing ring 608. The anchoring system comprises a rig vehicle 609, a rig rail 610, a lifting cylinder 611, a multi-functional rig 612, a shotcreting manipulator 613 and a material hoist 614. The anchoring system further comprises an advanced grouting system and a concrete additives filling apparatus. The advanced grouting system comprises the multi-functional rig 612 and a grouting pump 615. The auxiliary crane 601 of the module building system is installed on an upper portion of the device platform and is arranged for inverted transportation of the module board 602. The entire module board 602 is constructed by a plurality groups of individual module board unit which are secured directly onto all sides of the wall. The steel mesh in the lower portion of the module board is constructed manually. The materials, such as steel and steel arch, which is required below the well surface, is transported to the lower portion of the machine through the auxiliary hoist 513, and then is transported through the material hoist 614 to the construction site. After the manual binding of the steel is completed, the module board at the uppermost level is removed and is transported to a lower modeling location by the auxiliary crane 601 for module building, while the concrete sealing ring 608 is installed, then the grouting pipe 607 is connected to the grouting hole of the module board. Concrete is transported from the ground surface through the concrete pipe 106 of the center pillar, the transportation concrete pipe 603 and the buffer 604 to the concrete mixing tank 605 in the well bottom to process mixing so as to ensure the quality of the concrete. Then, the concrete pump 606 is used pumping the concrete to the inner portion of the module board through the grouting pipe 607 to complete the casting of wall for the shaft. The spray anchoring of the wall is mainly processed by using the multi-functional rig 612 and the shotcreting manipulator 613. Both of them are installed onto the rig rail 610 through the rig vehicle 609 and are arranged for circular movement to complete the task of anchoring, slurry pouring and spraying around all sides of the wall. The lifting cylinder 611 can control the lifting movement of devices so as to meet the need at different height level. When the geological condition is unstable, the multi-functional rig 609 can adjust its angle to work with the grouting pump 615 to complete the grouting work in the front end and the peripheral of the machine, to reinforce the geological stability in advance and prevent the occurrence of any incidence.

Figure 10:
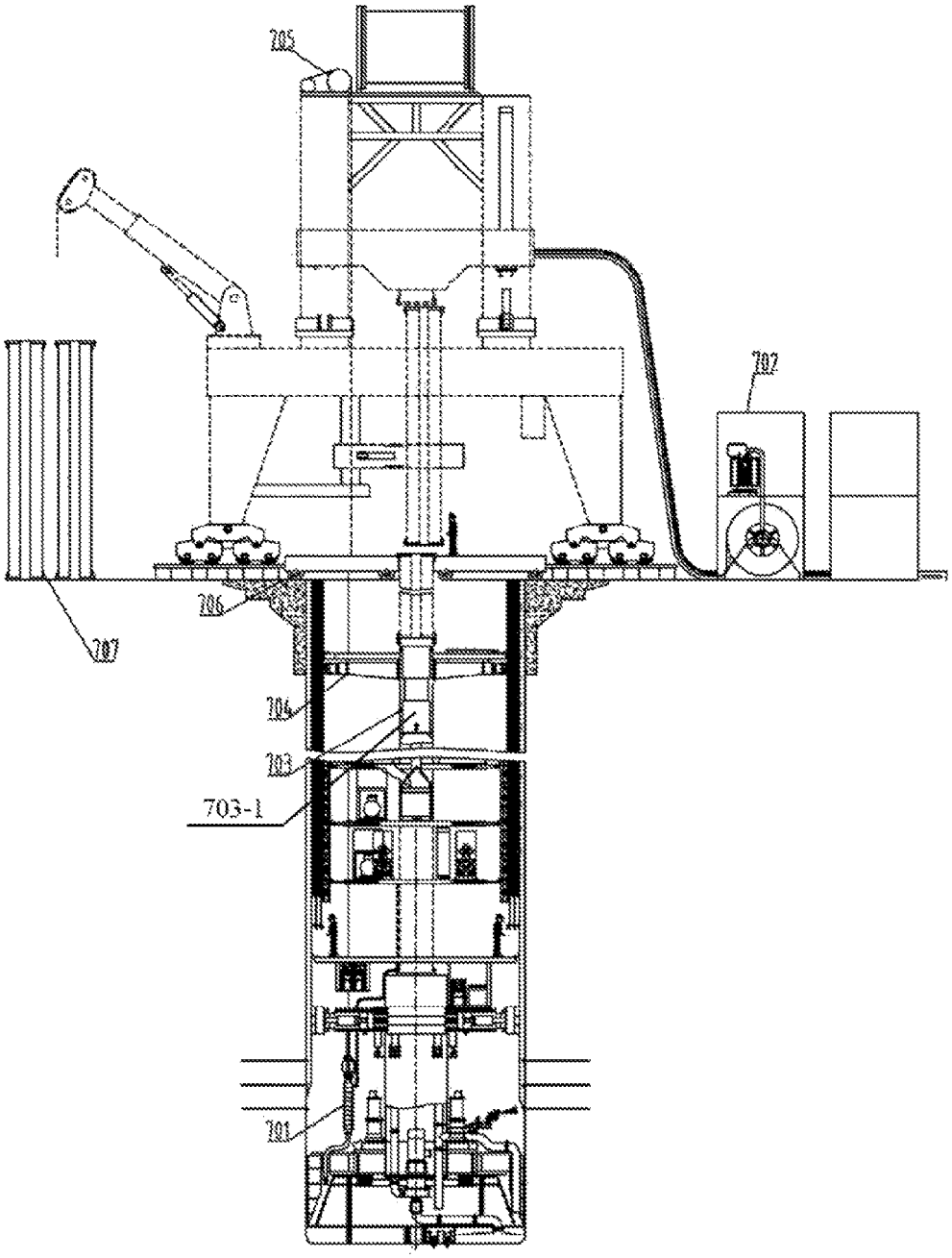
FIG. 10 is a schematic diagram of a safety system of the center pillar and full face vertical shaft drilling machine according to the preferred embodiment of the present invention.

Referring to FIG. 10 of the drawings, the safety system 7 comprises a sinking pump 701, a power control module 702, a ventilation and water passage module 703, a stabilizer 704, a stabilizing vehicle for sinking pump 705, a flat car for shaft cover 706 and a spare pillar 707. The power control module 702 comprises a main control room, an oil pump, an electrical cabinets, a transformer, an air compressor, a pumping station, a power cable, a communication cables and cable reel, which provides power source, system control, sealing and lubrication to all the devices of the machine. The ventilation and water passage module 703 comprises a fan, air duct formed inside the hollow portion of the center pillar and clean water pipe. The fan is installed at an inner side of the center pillar. The center pillar is function as an air dryer to blow the polluted air below the well surface to flowing outside the shaft rapidly, that this design is compact and has high air passage efficiency. The piping such as the water pipe and cable is directly installed around the center pillar and is extended together with the center pillar, that the piping extension is simple and fast. The sinking pump 701 is directly hanged at a bottom portion of the machine through the stabilizing vehicle for sinking pump 705 at an upper portion of the derrick. The sinking pump 701 has independent suspension system and transportation passage. The sinking pump 701 has a water inlet which penetrates through the retractable shield to the slurry storage of the cutter head and is arranged for emergent water discharge. The stabilizer 704 is installed in the mounting base for stabilizer of the center pillar, and is arranged for stabilizing the center pillar and the entire machine during the process of excavation. The flat car for shaft cover 706 is installed independently on a rail of the ground surface for closing the opening of the shaft, and is used to support the loading of different devices when the center pillar is extending, and processing piping extension by using the crane for pillar 306 to lift the spare pillar 707.

The process of the present invention is as follows:

The main equipment is hanging onto the derrick 3 which is mounted on the ground surface through the center pillar 1. Through the lifting cylinder 304, the sliding frame 302 and the pillar for sliding frame 303 of the derrick, the upward and downward movement of the entire machine is controlled, and the lifting or forward excavation process of the equipment is realized. During excavation, the retractable shield 402 is firmly secured to the wall through gripping by the shield cylinder 406 to stabilize the cutter head 401 and provide anti-torque to other equipment. The gripper cylinder 411 provides gripping force to the gripper 410 to secure onto the wall, thus providing auxiliary anti-torque to the retractable shield to prevent rotational movement of equipment during the excavation process. The main driver 404 is started to drive the cutter head 401 to process excavation and rock breaking and the lifting cylinder 304 on the ground surface is used to control the applied pressure of the cutter head 401 to realize high efficient excavation process. The rock fragment resulted from cutting action of the cutter head 401 is carried by the high speed flowing slurry and is transported by the slurry pump 501 through pumping to the slurry treatment station. Through the primary vibrating screen, 504, the secondary vibrating screen 505, the tertiary vibrating screen 506, the primary hydrocyclone device 507 and the secondary hydrocyclone device 508, slag and slurry are separated and are arranged to store inside the muck storage 509 and the slurry storage tank 510 respectively. The slag inside the muck storage 509 is loaded into the bucket 512 rapidly through the rapid feeding device 511 at its bottom portion, transported outside to the ground surface through the main hoist 513, and then loaded to a vehicle through the muck chute 309 to transport to a predetermined location. The slurry stored inside the slurry storage tank 510 is backflow to the cutter head through the slurry return pipe 515 for carrying out another cycle, thus a continuous slag removal process is achieved. The highly concentrated slurry deposited on the bottom of the slurry storage tank 510 is transported to the treatment station on the ground surface through the transportation pump 516. The deterioration of slurry after a long period of usage in the shaft bottom will occur and require a replacement of new and quality slurry, which is transported through the pipe for slurry inflow 109 of the center pillar and the slurry input pipe 518 to the slurry storage tank. The slurry after deterioration is pumped out through the transportation pump 516. Thus the replacement of slurry is completed to meet the construction need.

During the excavation process of the equipment, construction steps such as manual binding of steel, anchoring, spraying and casting steps are processed at the same time. The auxiliary hoist 514 is used to transport the materials required for wall support downward to the shaft. The material hoist 614 is used to distribute the materials to different construction sites. The multifunctional rig 612 is utilized for anchoring construction, manual binding is carried out for steel binding to construct the steel arch, then the shotcreting manipulator 613 is employed for carrying spraying for wall support such that incidences such as wall collapse is prevented. In the rear portion of the equipment, process secondary binding of steel and install the concrete sealing ring 608, transport the module board 602 by utilizing the auxiliary crane 601 and process casting. Then, connect the grouting pipe 607, transport concrete from the ground surface through the concrete pipe 106, the transportation concrete pipe 603 and the buffer 604 to the concrete mixing tank 605 in the shaft. Thereafter, the concrete is pumped through the concrete pump 606 to transport to an inner portion of the module board to complete the wall casting process.

During the construction process, advanced geological survey is conducted by utilizing the multi-functional rig 612. If special strata is encountered, the multi-functional rig 612 and the grouting pump 615 are used to carrying out grouting reinforcement for the sides of the wall and the front of the machine. The geological condition is improved and the construction safety is ensured.

As the equipment is processing excavation continuous at a downward direction, after the particular stroke of the lifting cylinder 304, the center pillar 1 and the auxiliary pipelines is completed, an extension process of the center pillar is required. Utilize the flat car for shaft cover 706 to lock the flange of the center pillar, remove the connecting bolts, move the sliding frame 302 at a upward position, disconnect the center pillar 1, hoist the spare pillar 707 rapidly through the crane for pillar 306 and utilize the manipulator for pillar 307 to precisely control and complete the docking of pillars. Thus, the extension of the center pillar 1 and other pipelines is processed. There is no need to transport the pipelines to the bottom of the shaft, the operation is convenience and highly efficient.

The center pillar and full face vertical shaft drilling machine according to the preferred embodiment of the present invention realizes the simultaneous operation of shaft drilling, support reinforcement and slag removal steps, thereby increasing the construction efficiency of shaft excavation, providing widespread applicability and construction safety. The construction time is shortened, the construction cost is lowered and has great significance for large-scale promotion.

One skilled in the art will understand that the embodiments of the present invention as shown in the drawings and described above are exemplary only and should not be limited as such. The embodiments have been shown and described for the purposes of illustrating the functional and structural principles of the present invention and is subject to change without departure from such principles.

What is claimed is:

1. A center pillar and full face vertical shaft drilling machine which comprises a center pillar, a device platform, a derrick, a boring system, a transportation system for people and materials, a support system for wall reinforcement system, a safety system and a control room, characterized in that, the derrick is provided at a shaft head on which the control room is located, said center pillar extended from a shaft bottom to the shaft head directly while connecting to a sliding frame of the derrick, the boring system is installed at a front end of the center pillar, and on the center pillar sequentially from a rear end to the front end installed a plurality of device platforms, the transportation system for people and materials, and the safety system is installed on the device platform located at a rear end of the boring system and the ground surface, the support system for wall reinforcement system is installed on the device platform located at the rear end of the boring system and surrounding of the device platform located at the rear end of the boring system, wherein said center pillar comprises a plurality segments of main body, each having a hollow columnar structure, connected through flanges and fastening members to form said center pillar, wherein a primary hoist rail, a secondary hoist rail, a cable, a compressed air pipe, a concrete pipe, a clean water pipe, a pipe for slurry outflow, a pipe for slurry inflow and a mounting base for stabilizer are arranged along the peripheral edges of said main body of said center pillar, said hollow portion of said center pillar defines a passage for a ventilation and water passage module of said safety system, said safety system comprises a fan installed directly at an inner side of said center pillar.

2. A center pillar and full face vertical shaft drilling machine which comprises a center pillar, a device platform, a derrick, a boring system, a transportation system for people and materials, a support system for wall reinforcement system, a safety system and a control room, characterized in that, the derrick is provided at a shaft head on which the control room is located, said center pillar extended from a shaft bottom to the shaft head directly while connecting to a sliding frame of the derrick, the boring system is installed at a front end of the center pillar, and on the center pillar sequentially from a rear end to the front end installed a plurality of device platforms, the transportation system for people and materials, and the safety system is installed on the device platform located at a rear end of the boring system and the ground surface, the support system for wall reinforcement system is installed on the device platform located at the rear end of the boring system and surrounding of the device platform located at the rear end of the boring system, wherein said device platform comprises a fixed platform; and a retractable platform installed on a segment of module lining of said center pillar, wherein said retractable platform comprises a base platform, a small platform, a retractable cylinder and a seal member, wherein said base platform is fixedly connected to said center pillar and said retractable cylinder is fixedly provided around a peripheral edge portion of said base platform horizontally, wherein said retractable cylinder comprises a piston shaft and is connected to said small platform through one end of said piston shaft, wherein said small platform has an outer portion at which said seal member is provided, wherein said seal member has an outer end which is in contact with said module lining of said center pillar.

3. A center pillar and full face vertical shaft drilling machine which comprises a center pillar, a device platform, a derrick, a boring system, a transportation system for people and materials, a support system for wall reinforcement system, a safety system and a control room, characterized in that, the derrick is provided at a shaft head on which the control room is located, said center pillar extended from a shaft bottom to the shaft head directly while connecting to a sliding frame of the derrick, the boring system is installed at a front end of the center pillar, and on the center pillar sequentially from a rear end to the front end installed a plurality of device platforms, the transportation system for people and materials, and the safety system is installed on the device platform located at a rear end of the boring system and the ground surface, the support system for wall reinforcement system is installed on the device platform located at the rear end of the boring system and surrounding of the device platform located at the rear end of the boring system, wherein said derrick comprises a main body of derrick, said sliding frame, a pillar for sliding frame, a lifting cylinder, a movement arrangement, a crane for pillar, a manipulator for pillar, a power station and a muck chute; wherein said main body of derrick has a lower portion at which said movement arrangement is provided and an upper portion at which said pillar for sliding frame and said power station are installed, wherein said pillar for sliding frame guides a sliding movement of said sliding frame, wherein said lifting cylinder has one end connected to said sliding frame and another end connected to a bottom end of said pillar for sliding frame, wherein said crane for pillar is installed on said upper portion of said main body of derrick, wherein said manipulator for pillar and said muck chute are inclined and installed at said lower portion of said main body of derrick.

4. A center pillar and full face vertical shaft drilling machine which comprises a center pillar, a device platform, a derrick, a boring system, a transportation system for people and materials, a support system for wall reinforcement system, a safety system and a control room, characterized in that, the derrick is provided at a shaft head on which the control room is located, said center pillar extended from a shaft bottom to the shaft head directly while connecting to a sliding frame of the derrick, the boring system is installed at a front end of the center pillar, and on the center pillar sequentially from a rear end to the front end installed a plurality of device platforms, the transportation system for people and materials, and the safety system is installed on the device platform located at a rear end of the boring system and the ground surface, the support system for wall reinforcement system is installed on the device platform located at the rear end of the boring system and surrounding of the device platform located at the rear end of the boring system, wherein said boring system for the vertical shaft drilling comprises a cutter head with rear mounting construction, a retractable shield, a shield positioning ring, a main driver, a shield cylinder, a guiding pillar, a propulsion cylinder, a gripper sliding ring, a gripper and a gripper cylinder; wherein said cutter head is connected to said main driver, said main driver has an upper portion connecting to said guiding pillar, said guiding pillar has a upper portion connecting to said center pillar, said main driver is connected to said shield positioning ring, said shield positioning ring is connected to said retractable shield through telescopic structure and said shield cylinder to form a ring-shaped retractable shield, said guiding pillar has a key structure and has a sliding connection with said gripper sliding ring while both said guiding pillar and said gripper sliding ring are connected through said plurality of propulsion cylinders provided around all sides, said gripper is connected to said gripper sliding ring through telescopic structure and said gripper cylinder, said control station is installed on an upper portion said gripper.

5. A center pillar and full face vertical shaft drilling machine which comprises a center pillar, a device platform, a derrick, a boring system, a transportation system for people and materials, a support system for wall reinforcement system, a safety system and a control room, characterized in that, the derrick is provided at a shaft head on which the control room is located, said center pillar extended from a shaft bottom to the shaft head directly while connecting to a sliding frame of the derrick, the boring system is installed at a front end of the center pillar, and on the center pillar sequentially from a rear end to the front end installed a plurality of device platforms, the transportation system for people and materials, and the safety system is installed on the device platform located at a rear end of the boring system and the ground surface, the support system for wall reinforcement system is installed on the device platform located at the rear end of the boring system and surrounding of the device platform located at the rear end of the boring system, wherein said transportation system for people and materials comprises a slurry pump, a slurry inflow pipe, a slurry outflow pipe, a primary vibrating screen, a secondary vibrating screen, a tertiary vibrating screen, a primary hydrocyclone device, a secondary hydrocyclone device, a muck storage, a slurry storage tank, a rapid feeding device, a bucket, a main hoist, an auxiliary hoist, a slurry return pipe, a transportation pump, a slurry output pipe, a slurry input pipe, a primary slurry pump, a secondary slurry pump, a primary slurry tank, a secondary slurry tank and a cage; wherein said slurry pump is installed inside said main driver, said slurry inflow pipe is extended to inside said cutter head, said slurry outflow pipe has an inlet connected to said slurry pump and an outlet connected to said primary vibrating screen, said primary vibrating screen has a primary vibrating screen slag outlet corresponding to said muck storage, a muck storage slag outlet of said muck storage is connected to said primary slurry tank, said primary slurry tank is thoroughly connected to said secondary slurry tank, said secondary slurry tank has a bottom portion connecting to said primary slurry pump, said primary slurry pump has an inlet connecting to said secondary slurry tank and an outlet connecting to said primary hydrocyclone device, said primary hydrocyclone device has a primary hydrocyclone device slag outlet connecting to said secondary vibrating screen and a primary hydrocyclone device slurry outlet connecting to said secondary slurry tank and said slurry storage tank respectively, said secondary vibrating screen has a secondary vibrating screen slag outlet corresponding to said muck storage and a secondary vibrating screen slurry outlet connecting to said secondary slurry tank; said slurry storage tank has a bottom portion connecting to said secondary slurry pump, said secondary slurry pump has an inlet connecting to said slurry storage tank and an outlet connecting to said secondary hydrocyclone device, said secondary hydrocyclone device has a slag outlet connecting to said tertiary vibrating screen and a slurry outlet connecting to said slurry storage tank, said tertiary vibrating screen has a slag outlet corresponding to said muck storage and a slurry outlet corresponding to said slurry storage tank; said slurry input pipe is extended to the ground surface through said center pillar and connected to a slurry tank on the ground surface and has a bottom portion connecting to said slurry return pipe, while said slurry return pipe is connected to said slurry storage tank, said slurry return pipe has an outlet terminal arranged on a work surface of said cutter head; said slurry storage tank has a bottom portion connected to said transportation pump, said transportation pump is connected to said slurry output pipe, said slurry output pipe is connected to said pipe for slurry outflow installed on said center pillar and has an outlet arranged on the shaft opening and connected to external slurry treatment station; said muck storage has a bottom portion at which said rapid feeding device is arranged, said bucket and said cage are installed on said center pillar, said main hoist and said auxiliary hoist are installed on said upper portion of said derrick.

6. A center pillar and full face vertical shaft drilling machine which comprises a center pillar, a device platform, a derrick, a boring system, a transportation system for people and materials, a support system for wall reinforcement system, a safety system and a control room, characterized in that, the derrick is provided at a shaft head on which the control room is located, said center pillar extended from a shaft bottom to the shaft head directly while connecting to a sliding frame of the derrick, the boring system is installed at a front end of the center pillar, and on the center pillar sequentially from a rear end to the front end installed a plurality of device platforms, the transportation system for people and materials, and the safety system is installed on the device platform located at a rear end of the boring system and the ground surface, the support system for wall reinforcement system is installed on the device platform located at the rear end of the boring system and surrounding of the device platform located at the rear end of the boring system, wherein said support system for wall reinforcement comprises a module building system and an anchoring system, wherein said module building system comprises an auxiliary crane, a module board, a transportation concrete pipe, a buffer, a concrete mixing tank in shaft bottom, a concrete pump, a grouting pipe, and a concrete sealing ring, said anchoring system comprises a rig vehicle, a rig rail, a lifting cylinder, a multi-functional rig, a shotcreting manipulator and a material hoist; said auxiliary crane of said module building system is installed on a rear side of said device platform for inverted transportation of said module board, said entire module board and said concrete sealing ring forms a casting cavity, said buffer with multi-level is installed on said transportation concrete pipe, said transportation concrete pipe has a bottom end connected to concrete mixing tank, said concrete mixing tank has a bottom portion at which said concrete pump is installed, said concrete pump has an outlet connected to a grouting opening of said entire module board through said grouting pipe; said rig rail of said anchoring system is connected to said sliding ring through said lifting cylinder and has sliding connection with said guiding pillar, said rig vehicle is installed on said rig rail, said multi-functional rig is installed on said rig vehicle, said shotcreting manipulator is also installed on said rig rail, said material hoist is installed at a lower portion of said device platform which is position at a higher position function as an operation platform for steel binding.

7. The center pillar and full face vertical shaft drilling machine according to claim 6, characterized in that, said entire module board is formed by assembling a plurality groups of individual module board unit and is secured directly onto all sides of the wall of the shaft.

8. The center pillar and full face vertical shaft drilling machine according to claim 6, characterized in that, said support system for wall reinforcement further comprises an advanced grouting system and a concrete additives filling apparatus, said advanced grouting system is formed by said multi-functional rig and said grouting pump, said grouting pump is installed on said device platform at a rear position.

9. A center pillar and full face vertical shaft drilling machine which comprises a center pillar, a device platform, a derrick, a boring system, a transportation system for people and materials, a support system for wall reinforcement system, a safety system and a control room, characterized in that, the derrick is provided at a shaft head on which the control room is located, said center pillar extended from a shaft bottom to the shaft head directly while connecting to a sliding frame of the derrick, the boring system is installed at a front end of the center pillar, and on the center pillar sequentially from a rear end to the front end installed a plurality of device platforms, the transportation system for people and materials, and the safety system is installed on the device platform located at a rear end of the boring system and the ground surface, the support system for wall reinforcement system is installed on the device platform located at the rear end of the boring system and surrounding of the device platform located at the rear end of the boring system, wherein said safety system comprises a sinking pump, a power and control module, a ventilation and water passage module, a stabilizer, a stabilizing vehicle for sinking pump, a flat car for shaft cover and a spare pillar, wherein said power control module comprises a main the control room, an oil pump, an electrical cabinets, a transformer, an air compressor, a pumping station, a power cable, a communication cables and a cable reel, said ventilation and water passage module comprises a fan, an air duct formed from an inner side of said hollow portion of said center pillar and a clean water pipe, said sinking pump is hanged directly at a bottom portion of said center pillar and full face vertical shaft drilling machine through said stabilizing vehicle for sinking pump at said upper portion of said derrick, said sinking pump has a water inlet which penetrates through said retractable shield of said boring system to said slurry storage of said cutter head, said power and control modules are distributed and installed on different device platforms and the ground surface, said stabilizer is installed in said mounting base for stabilizer of said center pillar, said flat car for shaft cover is installed independently on an independent rail on the ground surface, said spare pillar is arranged on a side of said machine for backup.

* * * * *